US008262189B2

(12) United States Patent
Iesaki et al.

(10) Patent No.: US 8,262,189 B2
(45) Date of Patent: Sep. 11, 2012

(54) CONVEYANCE DEVICE AND IMAGE FORMING APPARATUS

(75) Inventors: Kenichi Iesaki, Ichinomiya (JP); Kohei Terada, Kiyosu (JP); Mitsuhiro Nozaki, Nagoya (JP); Tomoaki Hazeyama, Yokkaichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 355 days.

(21) Appl. No.: 12/732,229

(22) Filed: Mar. 26, 2010

(65) Prior Publication Data

US 2011/0074856 A1 Mar. 31, 2011

(30) Foreign Application Priority Data

Sep. 30, 2009 (JP) ..... 2009-227850

(51) Int. Cl.
*B41J 29/393* (2006.01)
*B41J 23/00* (2006.01)

(52) U.S. Cl. ..... 347/19; 347/37

(58) Field of Classification Search ..... 347/19, 347/37

See application file for complete search history.

(56) References Cited

U.S. PATENT DOCUMENTS

| | | | | |
|---|---|---|---|---|
| 2005/0078137 | A1 | 4/2005 | Juan et al. | |
| 2007/0070118 | A1 * | 3/2007 | Nakata et al. | 347/37 |
| 2007/0076259 | A1 * | 4/2007 | Nakata et al. | 358/2.1 |
| 2009/0237744 | A1 | 9/2009 | Ogura et al. | |

FOREIGN PATENT DOCUMENTS

| | | |
|---|---|---|
| JP | 2005-186609 | 7/2005 |
| JP | 2006-240026 | 9/2006 |
| JP | 2007-083635 | 4/2007 |
| JP | 2007-083636 | 4/2007 |
| JP | 2007-090610 | 4/2007 |
| JP | 2007-107892 | 4/2007 |
| JP | 2009-029037 | 2/2009 |

* cited by examiner

*Primary Examiner* — Julian Huffman
(74) *Attorney, Agent, or Firm* — Banner & Witcoff, Ltd.

(57) ABSTRACT

A conveyance device includes a linear encoder that outputs an encoder signal corresponding to displacement of a conveyed object. The encoder includes an encoder fence provided on an intersecting plane that intersects a reference plane orthogonal to a direction in which a guide element supports the conveyed object. The encoder fence is configured such that a plurality of light-transmitting portions and light-shielding portions are arranged alternately on a side of the encoder fence. The light-transmitting portions and the light-shielding portions are formed so that a first point on each boundary between each of the light-transmitting portions and each of the light-shielding portions adjacent to each other and a second point on the each boundary, which is positioned separately from the first point with respect to a direction along the side of the encoder fence and perpendicular to the conveying direction, are separately positioned with respect to the conveying direction.

17 Claims, 11 Drawing Sheets

CONVEYANCE DEVICE AND IMAGE FORMING APPARATUS

CROSS-REFERENCE TO RELATED APPLICATIONS

This application claims the benefit of Japanese Patent Application No. 2009-227850 filed on Sep. 30, 2009 in the Japanese Patent Office, the disclosure of which is incorporated herein by reference.

BACKGROUND

The present invention relates to a conveyance device that conveys a conveyed object in a predetermined conveying direction and an image forming apparatus.

Conventionally, there is a known conveyance device that conveys a carriage having a recording head (an ink-jet head or the like) mounted thereon in a main scanning direction. The conveyance device is included in an image forming apparatus that forms an image onto a sheet (paper or the like) placed below the recording head. In this kind of image forming apparatus, it is known that when a curled sheet or a bent sheet is fed, the recording head or the carriage may be brought into contact with the sheet and a paper jam may thereby occur.

In an image forming apparatus that includes an ink-jet head as a recording head, a nozzle part of the ink-jet head is poor in impact resistance, and when some force is applied to the nozzle part due to contact with a sheet, the nozzle part may be damaged. Therefore, measures are conventionally taken in which conveyance of the carriage is stopped by bringing a motor to an emergency stop. For example, a target position or a target speed, which is provided to a control system that controls the conveyance of the carriage, is compared with an actual position or an actual speed of the carriage measured by an encoder. If a difference between a target value and a measured value exceeds a threshold, it is determined that a load applied to the motor, which supplies drive power to the carriage, is abnormally increased due to a paper jam or the like. Based on the determination, the motor is brought to an emergency stop.

SUMMARY

When the conventional method is applied, in which the motor is brought to an emergency stop when abnormality in conveyance is detected by comparison between the target value and the measured value, abnormality cannot be detected unless the load applied to the motor is increased after the contact between the recording head or the carriage and the sheet is seriously advanced. That is, in the conventional method, there is a significant time lag between the time when the contact between the recording head or the carriage and the sheet actually begins and the time when the recording head or the carriage is stopped. Therefore, the recording head may be damaged during this time lag.

Accordingly, in one aspect of the present invention, it is preferable that occurrence of abnormality due to contact of an external object such as a sheet with a conveyed object can be promptly detected.

A conveyance device according to a first aspect of the present invention includes a conveyed object, a guide element, a conveyance unit, and a linear encoder. The guide element guides the conveyed object in a predetermined conveying direction while supporting the conveyed object. The conveyance unit conveys the conveyed object in the conveying direction along the guide element. The linear encoder outputs an encoder signal corresponding to displacement of the conveyed object.

In the conveyance device, the linear encoder includes an encoder fence and an encoder sensor. The encoder fence is provided on an intersecting plane which intersects a reference plane, and is configured as an elongated encoder fence in the conveying direction. The term "reference plane" here means a plane orthogonal to a direction in which the guide element supports the conveyed object.

The encoder fence is configured to have a plurality of light-transmitting portions that transmit light and a plurality of light-shielding portions that shield light arranged alternately in the conveying direction on a side along the intersecting plane. The encoder sensor includes a light-emitting element and a light-receiving element provided in such a manner as to sandwich therebetween a portion of the encoder fence having the light-transmitting portions and the light-shielding portions formed thereon. And the encoder sensor outputs the encoder signal in accordance with a light-receiving state of the light-receiving element that receives light outputted from the light-emitting element. The encoder sensor is fixed on the conveyed object.

Particularly, the encoder fence is configured to have the light-transmitting portions and the light-shielding portions formed thereon so that a first point and a second point on each boundary between each of the light-transmitting portions and each of the light-shielding portions adjacent to each other are separately positioned with respect to the conveying direction. The term "second point" here means a point on the each boundary, which is positioned separately from the first point with respect to "a direction along the side of the encoder fence and perpendicular to the conveying direction".

According to the conveyance device, the conveyed object is supported by the guide element and, therefore, upon occurrence of an event where some external force is applied to the conveyed object in a same direction where the guide element applies force to the conveyed object (supporting direction), the conveyed object is displaced in a direction perpendicular to the reference plane, for example, by departing from the guide element. Concurrently, the encoder sensor is also displaced in the direction perpendicular to the reference plane. In such a case, an edge interval, which is a time interval between edges of the encoder signal, changes because the each boundary between the each of the light-transmitting portions and the each of the light-shielding portions on the encoder fence is configured as described above.

Therefore, according to the present invention, it is possible to determine whether or not the encoder sensor is displaced in the direction perpendicular to the reference plane using the change in the edge interval as an indicator. Occurrence of the above-described event can be thereby detected indirectly. As a result, as for the external object which causes the above-described event upon contact with the conveyed object, it is possible to detect the contact between the conveyed object and the external object. Therefore, according to the conveyance device, occurrence of abnormality due to the contact of the external object with the conveyed object can be promptly detected.

In other words, unlike the prior art, in which the contact between the external object and the conveyed object is detected at a point when conveyance load is increased, in the conveyance device of the present invention, the abnormality can be detected at a point when the encoder sensor is displaced in the direction perpendicular to the reference plane due to contact between the external object and the conveyed object. This makes it possible to promptly detect occurrence of the abnormality due to the contact of the external object with the conveyed object.

Therefore, according to the present invention, the conveyed object can be inhibited from being damaged from the seriously advanced contact between the external object and the conveyed object by stopping the conveyance of the conveyed object at an early stage. As a result, according to the present invention, a superior conveyance device can be provided.

An image forming apparatus according to a second aspect of the present invention includes a conveyed object, a guide element, a conveyance unit, and a linear encoder, which correspond to the above-described conveyance device. However, the conveyed object includes a recording head that forms an image onto a sheet. The image forming apparatus causes the recording head to perform image forming operation onto the sheet while moving the conveyed object in a conveying direction through the conveyance unit. A sequence of line image along the conveying direction is thereby formed onto the sheet placed opposite the recording head.

According to the image forming apparatus, it is possible to promptly respond to contact between the recording head and the sheet, and cope with the contact thanks to a configuration similar to that of the above-described conveyance device. For example, the recording head can be inhibited from being damaged by the sheet by stopping conveyance of the recording head at an early stage.

BRIEF DESCRIPTION OF THE DRAWINGS

The preferred embodiments of the present invention will be described hereinafter with reference to the accompanying drawings, in which.

DETAILED DESCRIPTION OF THE PREFERRED EMBODIMENTS

First Embodiment

Figure 1A:
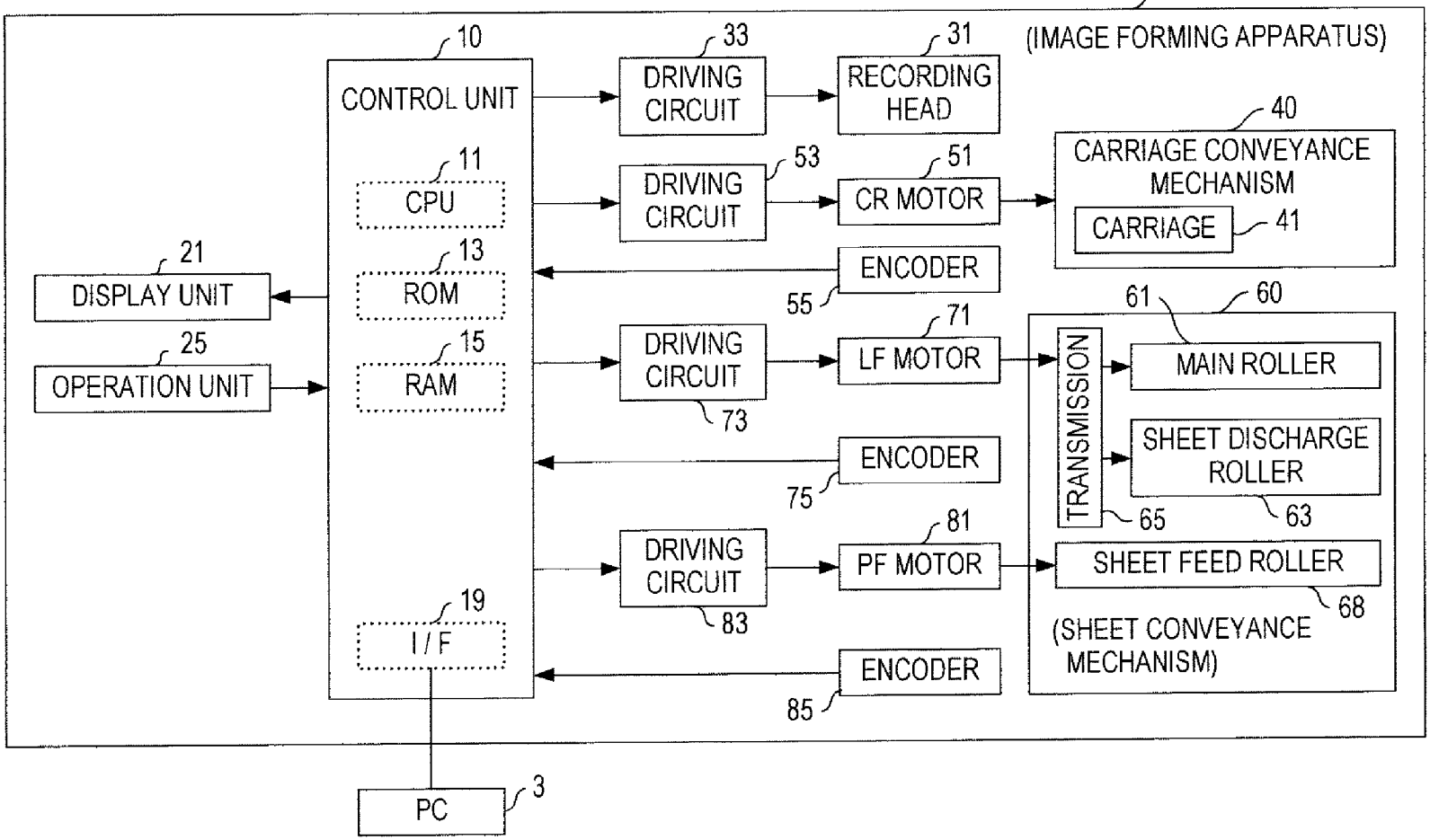
FIG. 1A is a block diagram showing an electrical configuration of an image forming apparatus according to a first embodiment.

An image forming apparatus 1 of the present embodiment as shown in FIG. 1A forms an image onto a sheet through a recording head 31 using an ink-jet printing system. The image forming apparatus 1 is configured such that a control unit 10 integrally controls the entire apparatus to achieve various functions. The control unit 10 includes a CPU 11, a ROM 13, a RAM 15, and an interface 19. The ROM 13 stores programs executed by the CPU 11. The RAM 15 is used as a work area during execution of the programs by the CPU 11. The interface 19 is used for connection to an external device such as a PC 3. The control unit 10 further includes other circuits that achieve the various functions, and achieves the various functions using software and hardware circuits.

More specifically, the image forming apparatus 1 includes a display unit 21 such as a liquid crystal display and an operation unit 25. The display unit 21 displays a message to a user, and the operation unit 25 receives a command from the user. The control unit 10 controls the display unit 21 to display an error message or the like on the display unit 21, and executes processings in response to the user's command inputted through the operation unit 25.

Figure 1B:
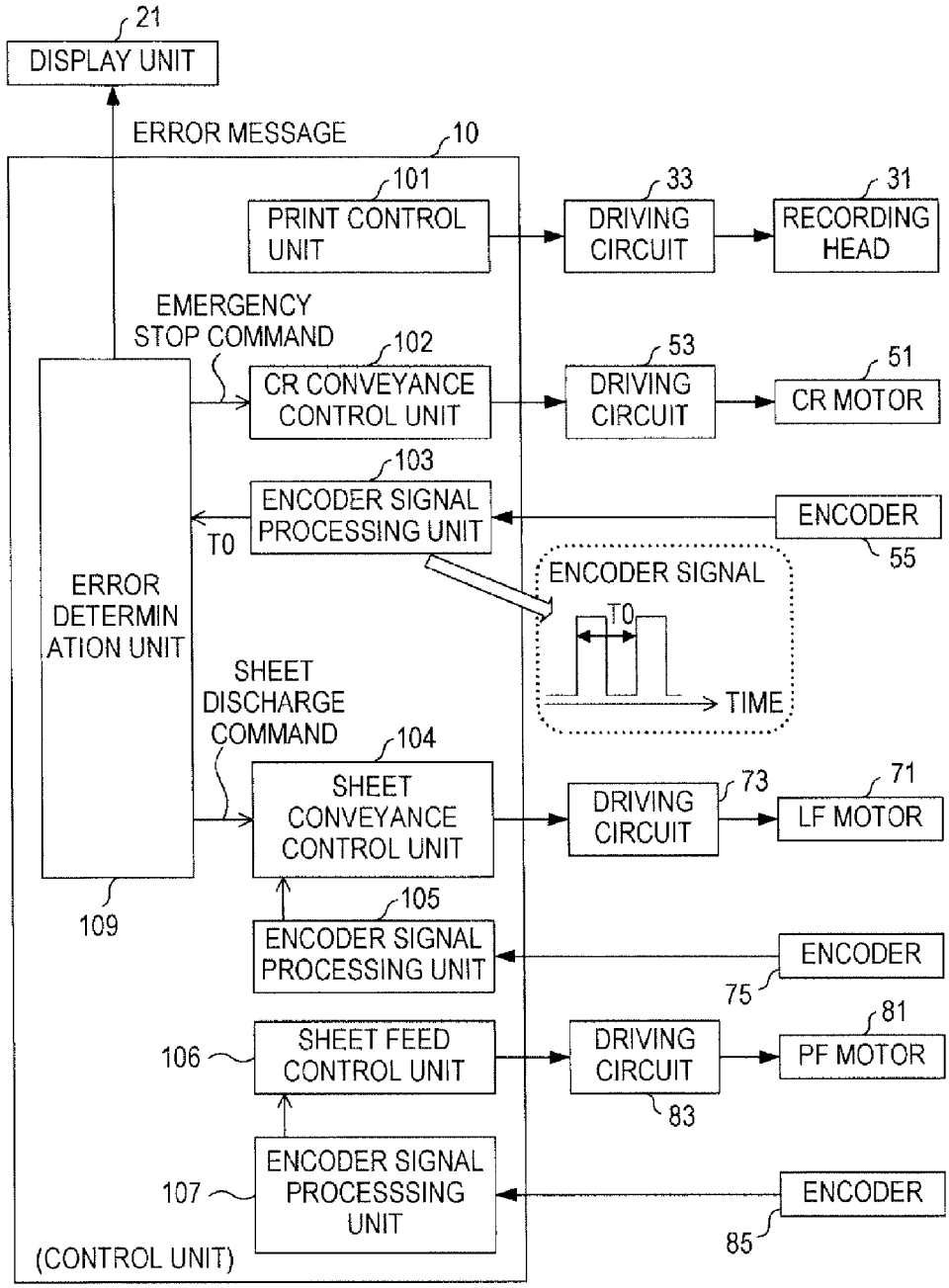
FIG. 1B is a block diagram explaining functions achieved in a control unit.

Furthermore, the image forming apparatus 1 includes the recording head 31 and a driving circuit 33 that drives the recording head 31. As shown in FIG. 1B, the control unit 10 functions as a print control unit 101 in cooperation with the software and the hardware circuits, and controls ejection of ink droplets from the recording head 31. Specifically, the print control unit 101 controls the ejection of the ink droplets from the recording head 31 by inputting a control signal into the driving circuit 33, and forms an image based on data of an image to be printed, which is provided by the external device such as the PC 3, onto a sheet conveyed by a sheet conveyance mechanism 60.

Additionally, the image forming apparatus 1 includes a CR motor 51, a driving circuit 53, a linear encoder 55, an LF motor 71, a driving circuit 73, a rotary encoder 75, a PF motor 81, a driving circuit 83, and a rotary encoder 85. The CR motor 51 is a direct current motor that supplies drive power to a carriage 41, on which the recording head 31 is mounted. The carriage 41 is included in a carriage conveyance mechanism 40. The driving circuit 53 drives the CR motor 51. The linear encoder 55 is used for measuring a position and a speed of the carriage 41. The LF motor 71 is a direct current motor that conveys a sheet to a position where an image is formed through the recording head 31 by rotating a main roller 61 and a sheet discharge roller 63. The main roller 61 and the sheet discharge roller 63 are included in the sheet conveyance mechanism 60. The driving circuit 73 drives the LF motor 71. The rotary encoder 75 is used for measuring a rotation amount of the LF motor 71. The PF motor 81 is a direct current motor that feeds a sheet from a sheet feed tray 69 (see FIG. 2) toward the main roller 61 by rotating a sheet feed roller 68 included in the sheet conveyance mechanism 60. The driving circuit 83 drives the PF motor 81. The rotary encoder 85 is used for measuring a rotation amount of the PF motor 81.

In short, the control unit 10 controls sheet conveyance from a feed process to a discharge process by inputting control signals into the driving circuits 53, 73, and 83, and also controls conveyance of the carriage 41 (and therefore the recording head 31).

Here, functions of the control unit 10 will be described in detail. The control unit 10 functions as an encoder signal processing unit 103 that measures the position and the speed of the carriage 41 based on a rectangle-like encoder signal inputted from the linear encoder 55. As in known techniques, the encoder signal processing unit 103 measures a moving direction (positive direction/negative direction) of the carriage 41 and a position X of the carriage 41 in a main scanning direction, based on an A-phase signal and a B-phase signal inputted from the linear encoder 55 as the encoder signal.

The encoder signal processing unit 103 measures the speed of the carriage 41 in the main scanning direction by measuring an pulse width T0 of either one of the A-phase signal and the B-phase signal. The pulse width T0 is a time length elapsed from when a leading edge is inputted last time until when a leading edge is inputted this time.

To be exact, a reciprocal of the pulse width T0 corresponds to the speed of the carriage 41. In the present embodiment, however, the speed of the carriage 41 is controlled to a target speed using the pulse width T0, which is an equivalent of the speed, as an indicator in order to reduce unnecessary computation.

Specifically, the control unit 10 functions as a CR conveyance control unit 102. The CR conveyance control unit 102 controls the CR motor 51 based on the position X and the pulse width T0, which are inputted from the encoder signal processing unit 103, and conveys the carriage 41 in the main scanning direction.

For example, during a process of forming an image onto a sheet, the CR conveyance control unit 102 conveys the carriage 41 on which the recording head 31 is mounted in the main scanning direction when intermittent conveyance of the sheet is stopped. The carriage 41 is thereby reciprocated in the main scanning direction in conformity to the sheet conveyance. Specifically, each time a predetermined amount of the sheet is sent forth in a sub-scanning direction perpendicular to the main scanning direction and the sheet conveyance is stopped, the CR conveyance control unit 102 switches a carriage conveying direction and conveys the carriage 41 to a return point along the main scanning direction. When the carriage 41 is reciprocated, the print control unit 101 causes the recording head 31 to eject ink droplets onto the sheet in a pattern corresponding to the data of an image to be printed. Due to this, the image is formed onto the sheet in the main scanning direction by an amount of lines sent forth in the sub-scanning direction.

When the image is formed onto the sheet, the carriage 41 is speed-controlled to the target speed until the carriage 41 reaches a point a predetermined distance short of the return point in the main scanning direction. The carriage 41 is thereby moved at a constant speed in an area where the recording head 31 ejects the ink droplets. After the carriage 41 reaches the point the predetermined distance short of the return point, the carriage is position-controlled to a target position, whereby to accurately stop the carriage 41 at a predetermined stop position (the return point).

The control unit 10 functions as a sheet conveyance control unit 104. The sheet conveyance control unit 104 controls the LF motor 71, and conveys the sheet sandwiched between the main roller 61 and a driven roller 62 in the sub-scanning direction. For example, when the image is formed onto the sheet, the sheet conveyance control unit 104 controls the LF motor 71 so that the sheet is sent forth in the sub-scanning direction by the predetermined amount each time.

Specifically, the control unit 10 functions as an encoder signal processing unit 105, which measures a sheet conveyance amount based on a encoder signal outputted from the rotary encoder 75. Then, the sheet conveyance control unit 104 controls the LF motor 71 based on the sheet conveyance amount measured by the encoder signal processing unit 105, and conveys the sheet in the sub-scanning direction by the predetermined amount each time, for example.

Drive power generated by the LF motor 71 is transmitted through a power transmitting mechanism 65 (see FIG. 1A) not only to the main roller 61 but also to the sheet discharge roller 63 located downstream of the main roller 61 (downstream along a sheet conveyance path) in the sub-scanning direction. The sheet discharge roller 63 is rotated in synchronization with the main roller 61, and sandwiches the sheet, which is conveyed from the main roller 61, between the same and the opposing driven roller 64 to discharge the sheet into a sheet receiving tray (not shown).

The control unit 10 further functions as a sheet feed control unit 106. The sheet feed control unit 106 controls the PF motor 81 to rotate the sheet feed roller 68 which abuts against a sheet placed in the sheet feed tray 69. The sheet feed control unit 106 thereby conveys an uppermost sheet placed in the sheet feed tray 69 downstream along the sheet conveyance path, and feeds the sheet between the main roller 61 and the driven roller 62 located downstream of the sheet conveyance path.

The control unit 10 still further functions as an encoder signal processing unit 107 that measures the sheet conveyance amount based on an encoder signal outputted from the rotary encoder 85. The sheet feed control unit 106 controls the PF motor 81 based on the sheet conveyance amount measured by the encoder signal processing unit 107.

Figure 2:
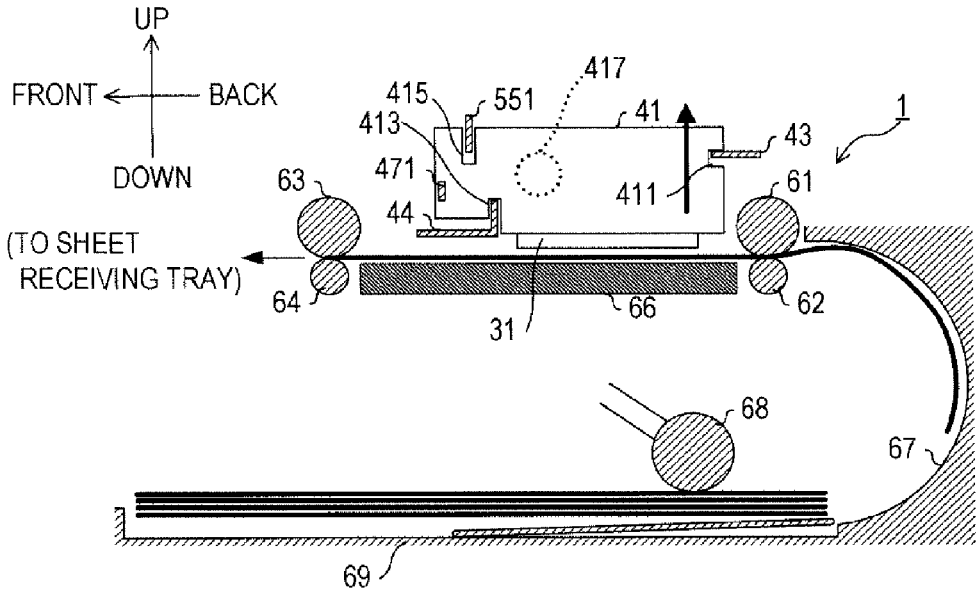
FIG. 2 is a cross-sectional view showing a carriage conveyance mechanism and a sheet conveyance mechanism.

With these functions of the control unit 10, as shown in FIG. 2, the sheet placed in the sheet feed tray 69 is separated one by one from the sheet feed tray 69, sent forth to a U-turn path 67 that constitutes the sheet conveyance path, and conveyed to a sandwiching position between the main roller 61 and the driven roller 62 located downstream of the sheet feed path. The sheet is drawn downstream along the sheet conveyance path due to rotation of the main roller 61 and the driven roller 62. Then, the sheet passes through a narrow space between a platen 66, which constitutes the sheet conveyance path, and the carriage 41, on which the recording head 31 is mounted, while an underside of the sheet is supported by the platen 66. When the sheet passes under the recording head 31, the image is formed onto the sheet. Further, the sheet is sandwiched between the sheet discharge roller 63 and the driven roller 64 located at a downstream end of the sheet conveyance path, and discharged into the sheet receiving tray (not shown).

Next, a configuration of the carriage conveyance mechanism 40 will be described with reference to FIGS. 2 and 3. The carriage conveyance mechanism 40 includes the carriage 41, frames 43 and 44 that guide the carriage 41 in the main scanning direction, and a belt mechanism 47 (see FIG. 3). The carriage 41 is slidably mounted on the frames 43 and 44 extending in the main scanning direction, and is configured to be connected to an endless belt 471, which constitutes the belt mechanism 47.

Specifically, the frame 43 is in contact with an upper surface of a groove portion 411 (see FIG. 2) that is provided on a side of the carriage 41 parallel to the main scanning direction to support the carriage 41 upward from underneath. On the other hand, the frame 44 has an L-shaped cross-section perpendicular to a longitudinal direction (main scanning direction), and functions as a guide rail that guides the carriage 41 in the main scanning direction. More specifically, the frame 44 is in contact with an upper surface of a groove portion 413 provided on a bottom of the carriage 41 parallel to the main scanning direction to guide the carriage 41 in the main scanning direction while supporting the carriage 41 upward from underneath.

In short, the carriage 41 is upwardly supported by the frames 43 and 44. Hereinafter, a plane, a normal direction of which is an upward direction in which the frames 43 and 44 support the carriage 41, is referred to as a reference plane. The carriage 41 is guided in the main scanning direction along the reference plane. Below the carriage 41, the platen 66 that supports the conveyed sheet is provided parallel to the reference plane, and the sheet is conveyed so as to be parallel to the reference plane below the carriage 41.

As shown in FIG. 2, the frame 43 is provided on a posterior side (upstream in the sub-scanning direction) of the carriage 41, and the frame 44 is provided on an anterior side of the carriage 41. In other words, in the present embodiment, the frame 43 supports a posterior portion of the carriage 41, and the frame 44 supports an anterior portion of the carriage 41. The carriage 41 is thereby retained so as not to lean forward or backward, and enabled to be conveyed stably in the main scanning direction along the frames 43 and 44.

The belt mechanism 47 includes the endless belt 471 and a pair of pulleys 473 and 474 arranged at each end of the frame 44 in the main scanning direction. The belt mechanism 47 is configured such that the endless belt 471 is supported by and between the pulleys 473 and 474.

The above-described CR motor 51 is connected to one of the pulleys 473 and 474 via a gear (not shown), and configured to allow the one pulley to rotate. In other words, in the present embodiment, the one of the pulleys 473 and 474 is rotated by receiving drive power generated by the CR motor 51 via the gear, whereas the other pulley is rotated by being driven by the one of the pulleys 473 and 474 via the endless belt 471.

The carriage 41 is fixed to the endless belt 471, and movement of the carriage 41 is restricted in the main scanning direction by the frames 43 and 44. Accordingly, when the CR motor 51 is rotated, the carriage 41 is moved in the main scanning direction (positive direction/negative direction) in synchronization with rotation of the endless belt 471.

In the present embodiment, with such a configuration of the carriage conveyance mechanism 40, the carriage 41 is conveyed in the main scanning direction. Additionally, the carriage conveyance mechanism 40 includes a capping mechanism 49 that covers nozzles of the recording head 31. When the image forming apparatus 1 is in a resting state, the recording head 31 is conveyed together with the carriage 41 to a position where the capping mechanism 49 is provided, and covered with a cap.

Figure 3:
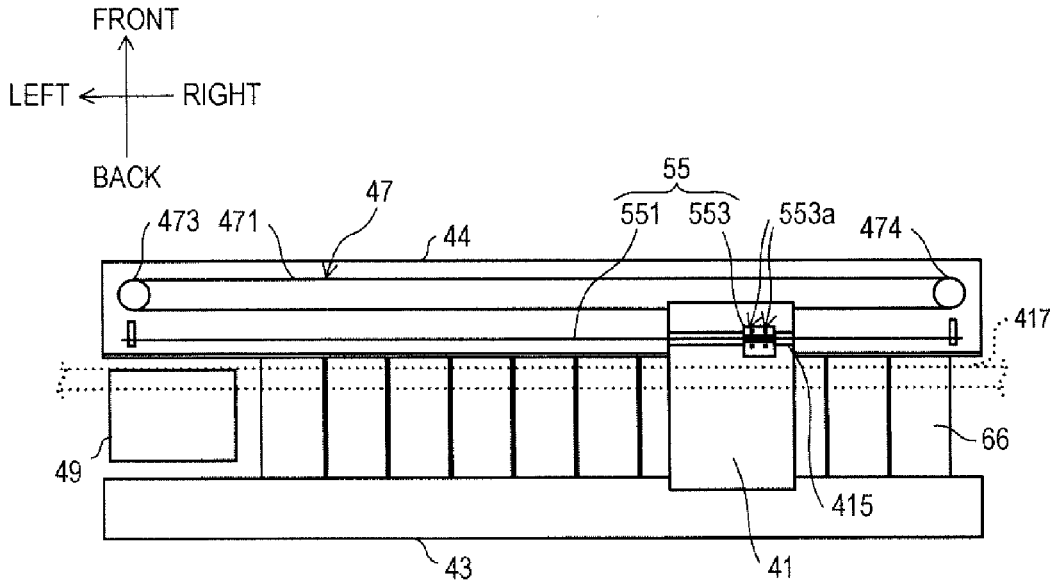
FIG. 3 is a top view showing the carriage conveyance mechanism.

Furthermore, as shown in FIG. 3, the linear encoder 55 used for measuring the position and the speed of the carriage 41 includes an encoder fence 551 and an encoder sensor 553. The encoder fence 551 is elongated in the main scanning direction. The encoder sensor 553 is fixed on the carriage 41 in such a manner as to sandwich a portion of the encoder fence 551.

The encoder fence 551 is elongatedly provided in the main scanning direction along a plane which is perpendicular to the above-described reference plane and also parallel to the main scanning direction. And the encoder fence 551 is configured to have a plurality of slits 551*a* of a predetermined shape arranged on the side thereof which is along the "plane which is perpendicular to the reference plane and also parallel to the main scanning direction". The details of the slits 551*a* will be described later with reference to FIGS. 5A and 5B. The encoder fence 551 is so disposed as to be inserted from above into a groove portion 415 provided on an upper surface of the carriage 41 parallel to the main scanning direction. Specifically, the encoder fence 551 is positioned in the groove portion 415 with a predetermined space therebetween so as not to contact with a bottom of the groove portion 415 (see FIG. 2).

The encoder sensor 553 is arranged such that a light-emitting element and a light-receiving element sandwich therebetween the encoder fence 551 inserted into the groove portion 415. Specifically, the encoder sensor 553 includes two pairs of detection circuits 553*a*. Each of the detection circuits 553*a* is composed of a pair of the light-emitting element and the light-receiving element. One of the detection circuits 553*a* generates and outputs the above-described A-phase signal, and the other detection circuits 553*a* generates and outputs the above-described B-phase signal.

The slit 551*a* (see FIGS. 5A and 5B) on the encoder fence 551 transmits light, which is outputted from the light-emitting element, to a side of the light-receiving element. On the other hand, a portion where the slit 551*a* is not formed on the encoder fence 551 shields transmission of light, which is outputted from the light-emitting element, to the side of the light-receiving element. As in known linear encoders, the detection circuit 553*a* outputs a low signal when the light-receiving element receives the light outputted from the light-emitting element through the slit 551*a*. And in other cases, the detection circuit 553*a* outputs a high signal. The detection circuit 553*a* thereby outputs a rectangle-like encoder signal corresponding to displacement of the carriage 41 having the encoder sensor 553 fixed thereon in the main scanning direction.

A basic configuration of the image forming apparatus 1 has been described above. The image forming apparatus 1 has a further function of detecting a contact between the carriage 41 or the recording head 31 fixed on the carriage 41 and a sheet positioned below the recording head 31 by detecting upward displacement of the carriage 41. With this function, the image forming apparatus 1 of the present embodiment can promptly detect abnormality at an early stage in the process of paper jam occurrence. The function will be hereinafter described.

First, an explanation will be given about a basic principle of a technique for detecting the upward displacement of the carriage 41.

Figure 4A:
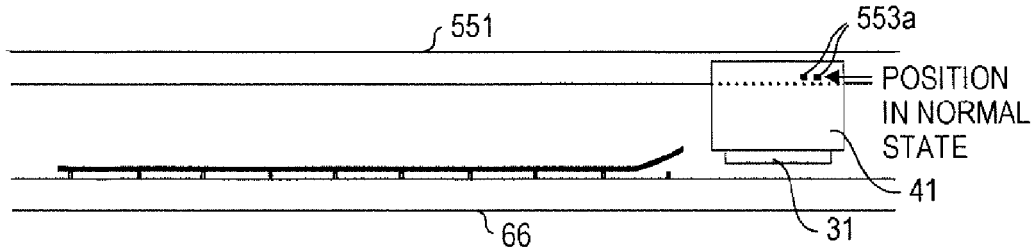
FIG. 4A is a side view showing a light emitting/receiving position where light is emitted/received by light emitting/receiving elements on an encoder sensor fixed on a carriage, in a state where a recording head fixed on the carriage and a sheet do not interfere with each other.
Figure 4B:
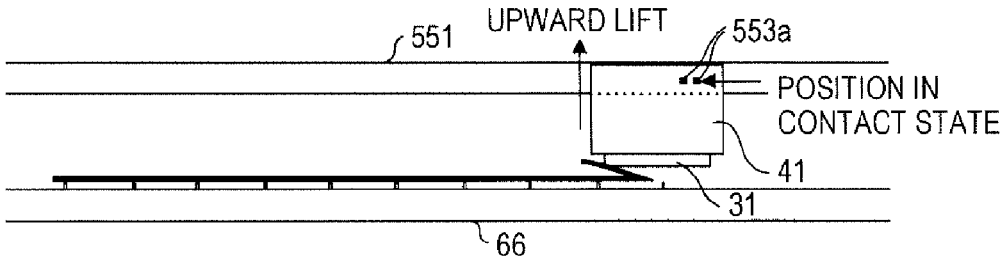
FIG. 4B is a side view showing a light emitting/receiving position where light is emitted/received by the light emitting/receiving elements, in a state where the recording head and the sheet interfere with each other.

As described above, in the image forming apparatus 1, the carriage 41 maintains its vertical position by being supported from underneath by the frames 43 and 44. Therefore, as shown in FIGS. 4A and 4B, if some power which pushes up the carriage 41 from underneath is generated, for example, due to contact with a sheet from underneath, the carriage 41 is lifted upward. Since the encoder sensor 553 is fixed on the carriage 41, the encoder sensor 553 is displaced upward in accordance with the upward displacement of the carriage 41, whereby a light emitting/receiving position is displaced upward accordingly.

Figure 5A:
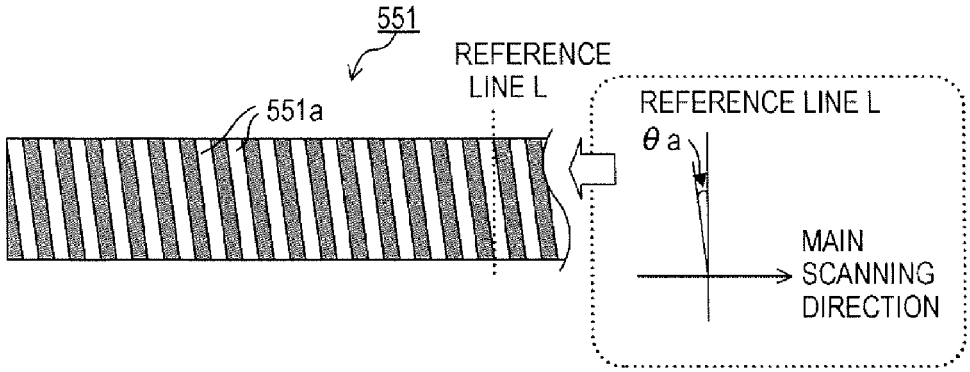
FIG. 5A is a side view showing an encoder fence along a vertical direction, specifically, a slit configuration of the encoder fence.
Figure 5B:
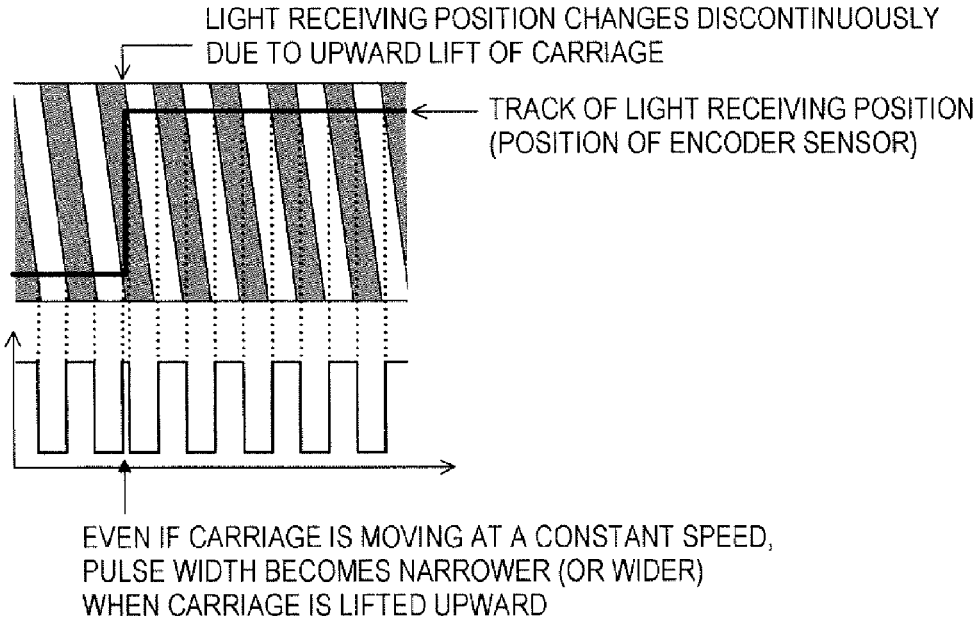
FIG. 5B is a schematic view showing a change in pulse width of an encoder signal in a case where the light emitting/receiving position of the encoder sensor is displaced upward with respect to the encoder fence due to upward lift of the carriage.

On the other hand, the encoder fence 551 is not displaced because the encoder fence 551 is fixed in the image forming apparatus 1 separately from the carriage 41. Accordingly, the light emitting/receiving position of the encoder sensor 553 with respect to the encoder fence 551 is displaced upward. In the present embodiment, the upward displacement of the carriage 41 is detected using such a phenomenon. Specifically, as shown in FIGS. 5A and 5B, the upward displacement of the carriage 41 is detected by suitably designing a slit configuration of the encoder fence 551. When the carriage 41 is displaced upward, the carriage 41 is lifted upward off of the frames 43 and 44. Therefore, the upward displacement of the carriage 41 is hereinafter also referred to as "upward lift".

Specifically, as shown in FIG. 5A, the encoder fence 551 includes the slit 551*a* on the side thereof. The slit 551*a* extends in a direction which is neither parallel to a (vertical) reference line L perpendicular to the main scanning direction along which the carriage 41 is conveyed, nor parallel to the main scanning direction. Unpainted portions shown in FIG. 5A correspond to the slits 551*a* that function as light-transmitting portions, whereas painted portions correspond to light-shielding portions.

On an encoder fence included in a conventional image forming apparatus, a slit is formed parallel to the reference line L perpendicular to the main scanning direction. In this regard, the image forming apparatus of the present embodiment is different from the conventional one.

Specifically, the encoder fence 551 of the present embodiment is configured to have the plurality of linear-shaped slits 551*a* arranged on the side thereof in a longitudinal direction thereof which corresponds to the main scanning direction. The slit 551*a* extends inclined at a predetermined angle of $\theta a$ ($0<\theta a<\pi/2$) with respect to the reference line L perpendicular to the main scanning direction.

In the image forming apparatus 1 with the encoder fence 551 configured as such, an edge of the slit 551*a* is inclined with respect to the reference line L. Therefore, a first point on the edge corresponding to a light emitting/receiving position in a normal state and a second point on the edge corresponding to a light emitting/receiving position at the time of upward lift of the carriage 41 are different in position with respect to the conveying direction (the main scanning direction) of the carriage 41.

Accordingly, as shown in FIG. 513, when the light emitting/receiving position of the encoder sensor 553 is displaced upward with respect to the encoder fence 551 due to the upward lift of the carriage 41, the pulse width T0 of the encoder signal is abruptly changed (see a lower part of FIG. 5B). Using such a phenomenon, in the present embodiment, it is determined that the carriage 41 is lifted upward when a rate of change $\Delta T$ of the pulse width T0 becomes a threshold TH or greater.

Figure 6A:
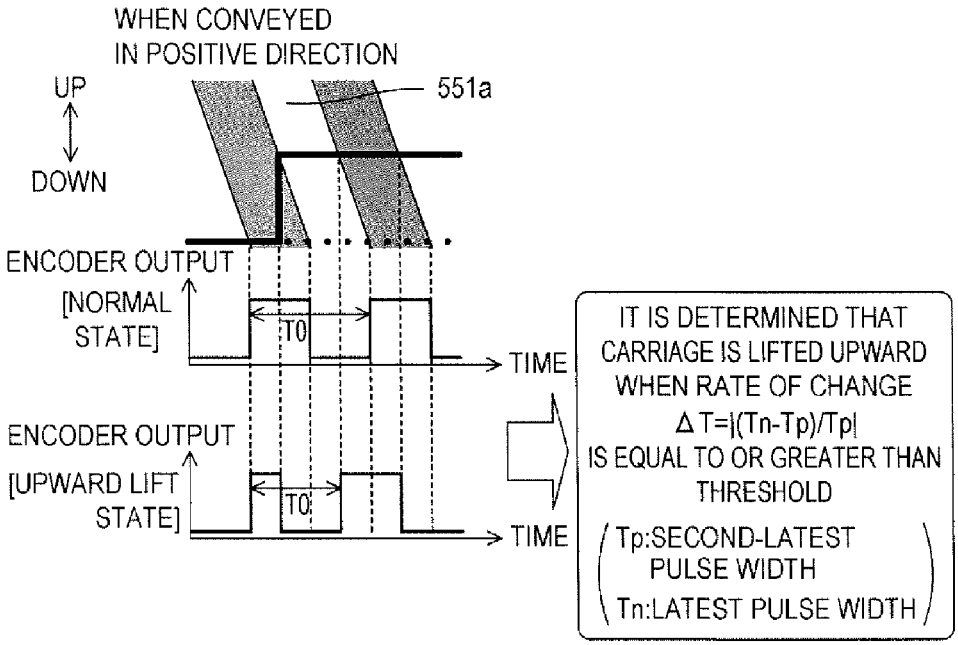
FIGS. 6A and 6B are schematic views showing a correspondence relationship between the displacement of the encoder sensor and the encoder signal, and the change in pulse width corresponding to each traveling direction of the carriage.
Figure 6B:
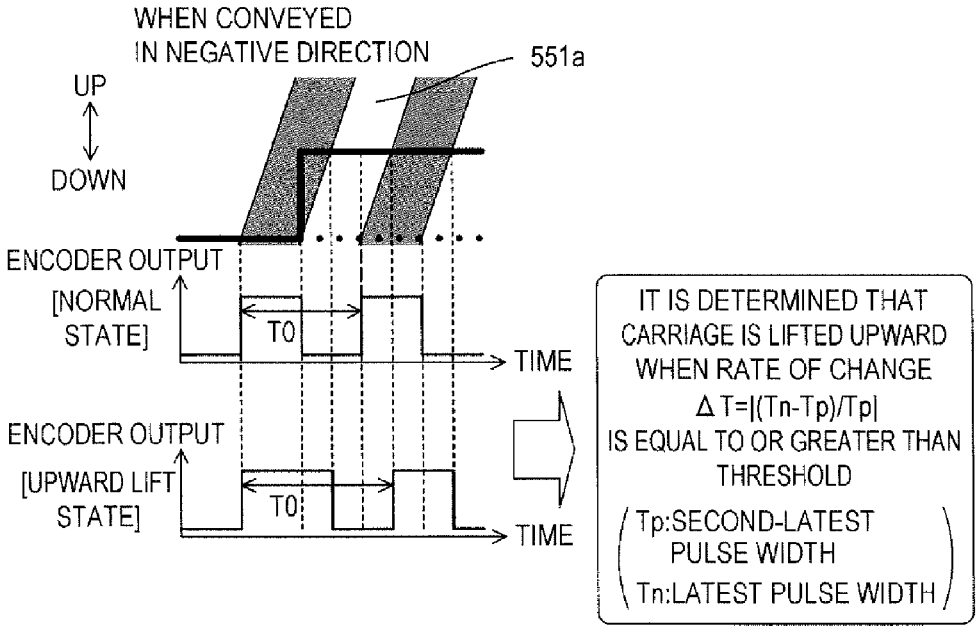

As shown in FIGS. 6A and 6B, the pulse width T0 becomes wider or narrower depending on a relationship between a direction of the slit 551*a* and a traveling direction of the carriage 41. For example, as shown in FIG. 6A, in a case where the slit 551*a* is inclined toward an upstream side of the conveying direction of the carriage 41, the pulse width T0 becomes narrower when the carriage 41 is lifted upward. On the other hand, as shown in FIG. 613, in a case where the slit 551*a* is inclined toward a downstream side of the conveying direction of the carriage 41, the pulse width T0 becomes wider when the carriage 41 is lifted upward.

Therefore, in the present embodiment, an absolute value as shown in the following formula is adopted as the rate of change $\Delta T$ of the pulse width T0, and when the rate of change $\Delta T$ becomes the threshold TH or greater, the upward lift of the carriage 41 is detected.

$$\Delta T=|(Tn-Tp)/Tp| \qquad \text{Formula (1)}$$

Here, time Tn corresponds to a latest measured pulse width T0, and time Tp corresponds to a second-latest measured pulse width T0.

In FIGS. 6A and 6B, with reference to a home position (the capping mechanism 49), a direction in which the carriage 41 travels away from the home position is referred to as a positive direction, and a direction in which the carriage 41 travels closer to the home position is referred to as a negative direction. How the pulse width T0 changes in accordance with an inclined direction of the slit 551*a* is shown in the drawings.

Figure 7:
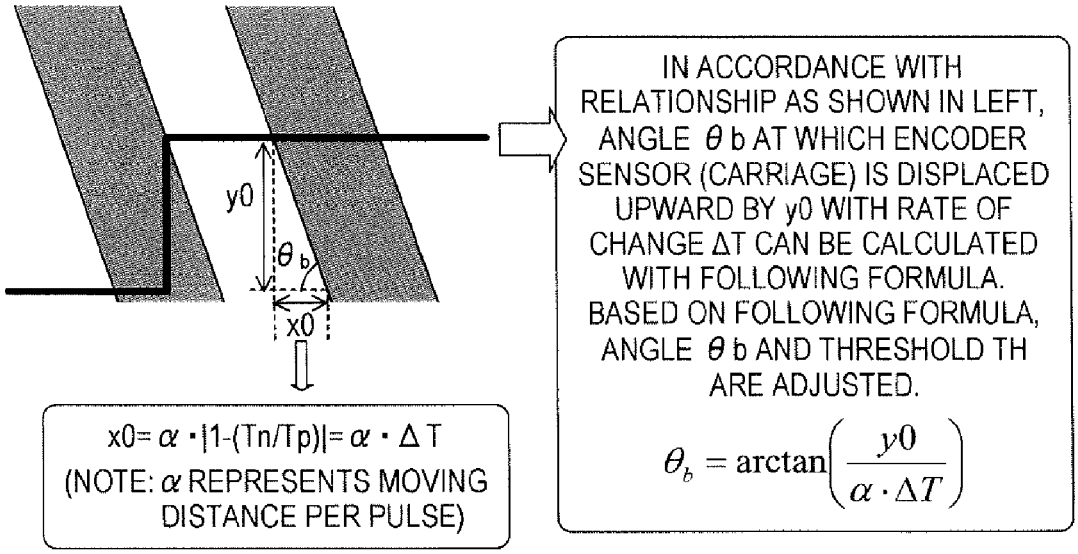
FIG. 7 is a schematic view explaining an angle θb of the slit in a case where a rate of change in pulse width becomes ΔT when the encoder sensor is displaced upward by y0.

In forming the slit 551*a*, it is necessary to adjust the angle $\theta a$ with respect to the reference line L, and the threshold TH. Therefore, an explanation will be given here about a method for adjusting the angle $\theta a$ and the threshold TH using an angle $\theta b$ instead of the angle $\theta a$. As shown in FIG. 7, the angle $\theta b$ represents an angle which the slit 551*a* forms with respect to the main scanning direction, and satisfies a formula: $\theta b=(\pi/2)-\theta a$ [radian].

Specifically, the angle $\theta b$ can be calculated with a following formula such that the rate of change of the pulse width T0 becomes $\Delta T$ when the carriage 41 (encoder sensor 553) is displaced upward by y0.

$$\theta b=\arctan\{y0/(\alpha\cdot\Delta T)\} \qquad \text{Formula (2)}$$

Here, a constant $\alpha$ represents an arrangement interval of the slit 551*a* formed on the encoder fence 551 in the main scanning direction, and corresponds to a moving distance of the carriage 41 per pulse of the encoder signal. In implementing the present embodiment, the angle $\theta a$ and the threshold TH may be adjusted in accordance with the above formula. In doing so, an upward displacement amount y0, with which the carriage 41 is considered to be lifted upward, and a measurement error of the rate of change $\Delta T$ should be taken into consideration.

Figure 8:
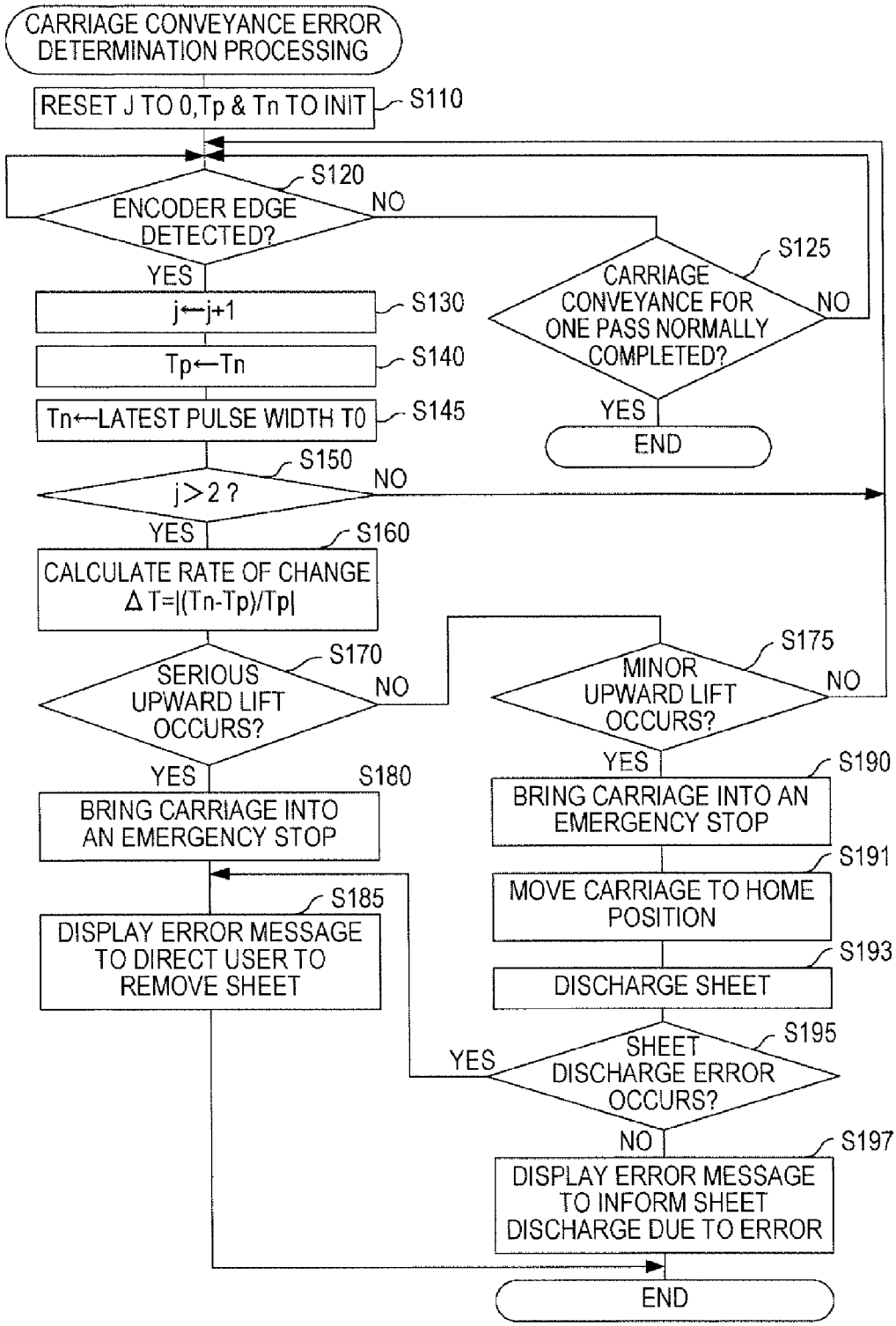
FIG. 8 is a flow chart illustrating a carriage conveyance error determination process executed by an error determination unit.

Next, an explanation will be given about a carriage conveyance error determination processing executed in order that the image forming apparatus 1 of the present embodiment may detect the upward lift of the carriage 41. As shown in FIG. 1B, the control unit 10 of the present embodiment functions as an error determination unit 109. By executing the carriage conveyance error determination processing as shown in FIG. 8, the error determination unit 109 determines whether or not the carriage 41 is lifted upward, and performs an error processing in accordance with a determination result. FIG. 8 is a flow chart showing the carriage conveyance error determination processing executed by the error determination unit 109 each time conveyance control for one pass of the carriage 41 is performed by the CR conveyance control unit 102. "Conveyance control for one pass" here means each one-way conveyance control of the reciprocating carriage 41 (in other words, conveyance control that conveys the carriage 41 to the return point).

The error determination unit 109 starts the carriage conveyance error determination processing along with a start of the conveyance control for one pass by the CR conveyance control unit 102. The error determination unit 109 resets a variable j, which represents a number of edge detection times of the encoder signal, to zero and sets variables Tn and Tp to initial values INITs (e.g., maximum values) (S110).

After completing the above processing, the error determination unit 109 determines whether or not the leading edge of the encoder signal inputted from the linear encoder 55 is detected by the encoder signal processing unit 103 (S120). When the leading edge is detected (S120: Yes), the process proceeds to S130, and when the leading edge is not detected (S120: No), the process proceeds to S125. Here, whether the leading edge of the encoder signal is detected or not is determined by applying one of the A-phase signal and the B-phase signal as the encoder signal.

In S125, the error determination unit 109 determines whether the carriage 41 is conveyed to the return point and the conveyance control for one pass by the CR conveyance control unit 102 is normally completed or not. When it is determined that the conveyance control for one pass is not normally completed (S125: No), the process proceeds to S120 and the error determination unit 109 stands by until the leading edge is detected or the conveyance control for one pass is normally completed.

When the leading edge is detected (S120: Yes), the error determination unit 109 updates the variable j by adding one thereto, and thereby counts the number of detection times of the leading edge through the variable j (S130). Further, the error determination unit 109 updates the variable Tp to a value of the current variable Tn (S140) and updates the variable Tn to a value equal to a latest pulse width T0 updated by the encoder signal processing unit 103 with the detection of the current leading edge (S145).

After the processing of S145 is completed, the process proceeds to 5150, where it is determined whether or not the leading edge is detected three times and the variable j is updated to a value greater than two (i.e., whether or not $j>2$ is satisfied).

Here, when it is determined that $j \leqq 2$ is satisfied (S150: No), the process proceeds to S120, and when it is determined that $j>2$ is satisfied (S150: Yes), the process proceeds to S160. The reason why the processing is switched as such is that the rate of change ΔT of the pulse width T0 cannot be normally calculated unless the leading edge is detected three times or more.

In S160, the error determination unit 109 calculates the rate of change ΔT according to the above formula (1). After this processing is completed, the process proceeds to S170, and it is determined whether or not a serious upward lift of the carriage 41 is occurring based on the calculated rate of change ΔT.

Specifically, in S170, whether or not the serious upward lift is occurring is determined by determining whether or not the calculated rate of change ΔT is equal to or greater than a predetermined threshold TH 2.

The image forming apparatus 1 of the present embodiment is so configured as to switch the error processing after determining bow advanced the paper jam is based on the rate of change ΔT. In order to switch the error processing, two thresholds TH1 and TH2 of different values are set in advance as the above threshold TH in the image forming apparatus 1. In S170, it is determined whether or not the rate of change ΔT is equal to or greater than the predetermined threshold TH2 by comparing the rate of change ΔT with the threshold TH2 (TH1), which has a greater value of the two thresholds TH1 and TH2. Then, it is thereby determined whether paper jam occurrence process is advanced and a serious upward lift is occurring or not. For example, the threshold TH2 may be set to 50%.

When the rate of change ΔT is equal to or greater than the threshold TH 2, it is determined that a serious upward lift is occurring (S170: Yes), and the process proceeds to S180. In S180, the error determination unit 109 commands the CR conveyance control unit 102 to bring the carriage to an emergency stop, and the CR conveyance control unit 102 urgently stops the carriage 41. In parallel, the error determination unit 109 controls the display unit 21 to display an error message which directs a user to remove the sheet by hand (S185). The carriage conveyance error determination processing is thus completed.

On the other hand, when it is determined that a serious upward lift of the carriage 41 is not occurring (S170: No), the process proceeds to S175, and the error determination unit 109 determines whether or not a minor upward lift is occurring based on the above rate of change ΔT. Specifically, it is determined whether or not the rate of change ΔT is equal to or greater than the predetermined threshold TH1 by comparing the rate of change ΔT with the threshold TH1, which has a smaller value than the threshold TH2. Then, it is thereby determined whether or not a minor upward lift of the carriage 41 is occurring. For example, the threshold TH1 may be set to 30%.

When the rate of change ΔT is less than the threshold TH1, it is determined that a minor upward lift is not occurring either (S175: No), and the process proceeds to S120. When a new leading edge is detected in S120, the processings after S130 are executed. When conveyance control for one pass of the carriage 41 is normally completed (S125: Yes), the carriage conveyance error determination processing is completed.

On the other hand, when the rate of change ΔT is equal to or greater than the threshold TH1, it is determined that a minor upward lift is occurring (S175: Yes), and the process proceeds to S190. As in S180, the error determination unit 109 commands the CR conveyance control unit 102 to bring the carriage to an emergency stop, and the CR conveyance control unit 102 urgently stops the carriage 41. After that, the error determination unit 109 commands the CR conveyance control unit 102 to move the carriage 41 to the home position (S191). Further, the error determination unit 109 commands the sheet conveyance control unit 104 to discharge the sheet (S193). Receiving the sheet discharge command, the sheet conveyance control unit 104 executes the sheet discharge processing to rotate the LF motor 71 and thereby to convey the sheet, which is drawn to downstream of the sheet conveyance path by the main roller 61, to the sheet receiving tray.

While the sheet conveyance control unit 104 is executing the sheet discharge processing, the error determination unit 109 monitors the execution process of the sheet discharge processing. When the sheet discharge processing is not normally completed because an error occurs during the sheet discharge (S195: Yes), the process proceeds to 5185, and the error determination unit 109 directs a user through an error message to remove the sheet by hand.

On the other hand, when the sheet discharge processing is normally completed (S195: No), an error message, which indicates that the sheet is discharged due to the error during the carriage conveyance, is displayed on the display unit 21 (S197). The carriage conveyance error determination processing is thus completed.

The image forming apparatus 1 of the present embodiment has been described above. According to the present embodiment, when the rate of change ΔT is equal to or greater than the threshold TH1, it is determined that the upward lift of the carriage 41 is occurring due to the contact with the sheet, and the carriage 41 is brought to an emergency stop. The paper jam occurrence process may be thereby inhibited from advancing. Therefore, according to the present embodiment, paper jam can be inhibited from being so deteriorated that the sheet discharge cannot be performed automatically. That can also avoid user's frustration. In addition, according to the present embodiment, when the recording head 31 is brought into contact with the sheet, the abnormality can be detected early and the conveyance of the carriage 41 can be stopped at an early stage. The nozzle part of the recording head 31 can be thereby inhibited from being damaged.

Further, in the present embodiment, when the rate of change ΔT is equal to or greater than the threshold TH2, the sheet is not discharged automatically on the assumption that the paper jam is advanced. Therefore, a situation where the paper jam is further advanced as a result of forcibly performing the sheet discharge processing can be inhibited, and it can be also avoided that a user is bothered with elimination of the paper jam.

With respect to the upward lift of the carriage 41, as a total weight of the carriage 41 and the recording head 31 becomes heavier, an upward lift amount y0 becomes smaller. In that case, it may be difficult to promptly detect abnormality and stop the carriage 41. In recent years, however, an ink cartridge tends not to be contained in the recording head 31 to make it easier to replace the ink cartridge. Instead, it becomes more common to arrange an ink cartridge in a place where the ink cartridge can be easily replaced from outside and supply the recording head 31 with ink from the ink cartridge by means of a tube.

In the image forming apparatus 1 configured such that the ink cartridge is not contained in the recording head 31, the total weight of the carriage 41 and the recording head 31 is small. Therefore, the carriage 41 may be lifted upward enough to be detected as abnormality at a early stage of the paper jam occurrence process.

Accordingly, the technique of the present embodiment may exert greater effect when applied in the image forming apparatus 1 of such a type that an ink cartridge is not contained in the recording head 31.

The method for calculating the rate of change ΔT is not limited to that based on the formula (1), but it may be sufficient if an amount of change in the measured pulse width can be calculated. In other words, the upward lift of the carriage 41 may be detected using a value obtained by calculating a ratio between the temporally second-latest pulse width and the latest pulse width. Further, Tp in the formula (1) may be not the second-latest pulse width but an average value of a plurality of pulse widths or a value corresponding to a target speed command at the time of driving the carriage 41.

In the above embodiment, the linear encoder 55 includes the encoder fence 551 configured to have the linear-shaped slit 551*a* arranged thereon, which extends inclined at the predetermined angle of θa with respect to the (vertical) reference line L. The encoder fence 551 may be configured to have, for example, a slit 551*b* arranged thereon, which is shaped as shown in FIG. 9A.

Figure 9A:
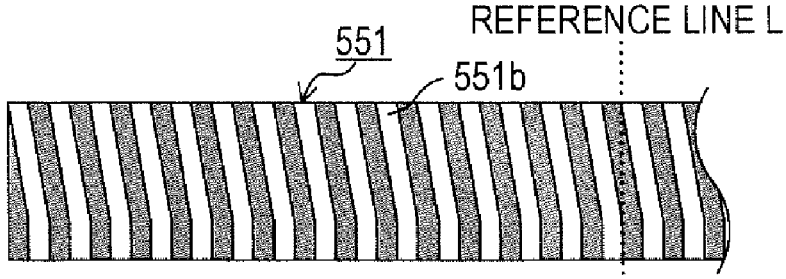
FIG. 9A is a side view showing the encoder fence having slits of a first modified embodiment provided thereon.

As shown in FIG. 9A, the encoder fence 551 of a first modified embodiment includes the slit 551*b* arranged on the side thereof. A lower area of the slit 551*b* is linearly shaped along a vertical direction (the reference line L) perpendicular to the main scanning direction, and an upper area of the slit 551*b* is linearly shaped and extends inclined at a predetermined angle of θa with respect to the vertical direction (the reference line L) perpendicular to the main scanning direction.

When the slit 551*b* shaped as such is provided on the encoder fence 551, the apparent speed fluctuation (fluctuation of the pulse width T0) of the carriage 41 due to the vertical inclination of the slit 551*b* does not occur until the carriage 41 is lifted upward to some extent.

In this regard, an explanation will be given in more detail. When the slit 551*a* shaped as shown in FIG. 5A is provided on the encoder fence 551, the apparent speed fluctuation (fluctuation of the pulse width T0) of the carriage 41 may occur due to the upward lift of the carriage 41 when any vibration is generated due to a cause other than the contact with the sheet.

On the other hand, when the slit 551*b* shaped as shown in FIG. 9A is provided on the encoder fence 551, the light emitting/receiving position of the encoder sensor 553 is displaced only within the lower area of the slit 551*b* if minute vibration is generated. Therefore, the apparent speed fluctuation of the carriage 41 accompanying the displacement thereof may not occur, and the speed of the carriage 41 may be accurately measured with the pulse width T0. Accordingly, when the slit 551*b* is shaped as shown in FIG. 9A, an error in speed measurement due to minute vibration may be inhibited from occurring and, therefore, the image forming apparatus 1 with excellent vibration resistance can be configured. However, even when the slit 551*a* shaped as shown in FIG. 5A is adopted, an effect of vibration and the like is limited. This is because, according to such a configuration of the slit 551*a*, the greater the displacement of the light emitting/receiving position of the encoder sensor 553 is, the greater a change in the pulse width is, and the smaller the displacement is, the smaller the change in the pulse width is.

Figure 9B:
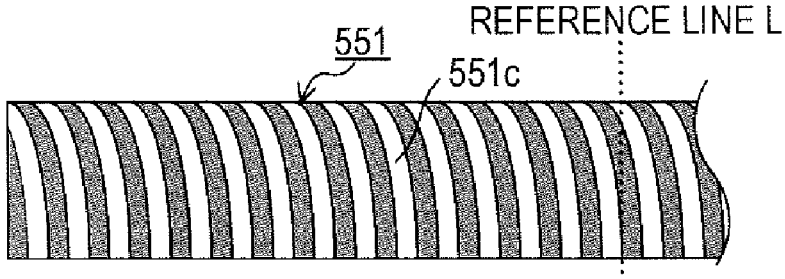
FIG. 9B is a side view showing the encoder fence having slits of a second modified embodiment provided thereon.

A similar effect to that of the slit 551*b* can be produced when a slit 551*c* shaped as shown in FIG. 9B is provided on the encoder fence 551.

As shown in FIG. 9B, the encoder fence 551 of a second modified embodiment includes the slit 551*c* arranged on the side thereof. The slit 551*c* is curvedly shaped (in other words, arc-like shaped) and an angle with respect to the vertical direction perpendicular to the main scanning direction becomes progressively larger toward an uppermost end. Specifically, the slit 551*c* is curvedly shaped so that a tangential line thereto is parallel to the vertical direction at a lowermost end.

According to the slit 551*c* shaped as such, when the encoder sensor 553 is fixed on the carriage 41 so that the light emitting/receiving position of the encoder sensor 553 is positioned around the lowermost end of the encoder fence 551 in the normal state where the carriage 41 is not lifted upward, the pulse width T0 does not change much if the carriage 41 is slightly lifted upward.

On the other hand, the larger the upward lift amount y0 becomes, the greater the rate of change ΔT of the pulse width T0 becomes. Accordingly, when the slit 551*c* shaped as such is adopted, the image forming apparatus 1 can be so configured to have vibration resistance and be able to accurately detect the upward lift of the carriage 41 due to contact with the sheet.

Figure 9C:
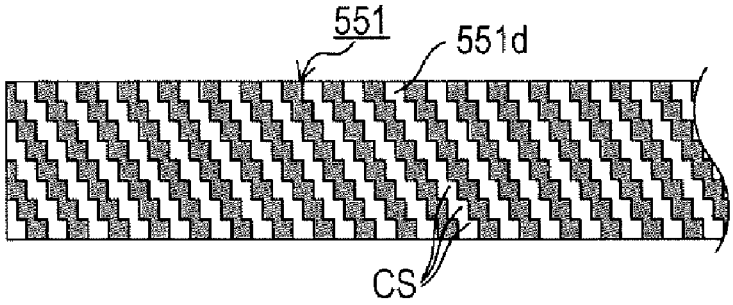
FIG. 9C is a side view showing the encoder fence having slits of a third modified embodiment provided thereon.

Alternatively, a slit 551*d* shaped as shown in FIG. 9C may be provided on the encoder fence 551.

As shown in FIG. 9C, the encoder fence 551 of a third modified embodiment includes the step-like shaped slit 551*d* arranged on the side thereof. The slit 551*d* is composed of a plurality of slit constituents CS, each of which is composed of rectangle-like hole, arranged lengthwise while being shifted gradually in the main scanning direction.

The encoder fence 551 that includes the slit 551*d* may bring about an effect of accurately determining the upward lift amount y0 of the carriage 41 based on the rate of change ΔT because the rate of change ΔT becomes greater stepwise in proportion to the upward lift amount y0 of the carriage 41.

Second Embodiment

An explanation will be given about an image forming apparatus 2 of a second embodiment. The image forming apparatus 2 of the second embodiment has a configuration similar to that of the image forming apparatus 1 except that a vertically movable frame member 90 is attached to a carriage 41' and the encoder 553 is mounted on the frame member 90. Accordingly, components configured identically with those in the image forming apparatus 1 of the first embodiment are hereinafter assigned the same referential numbers to omit an explanation thereof. Components peculiar to the image forming apparatus 2 of the second embodiment will be selectively explained.

Figure 10A:
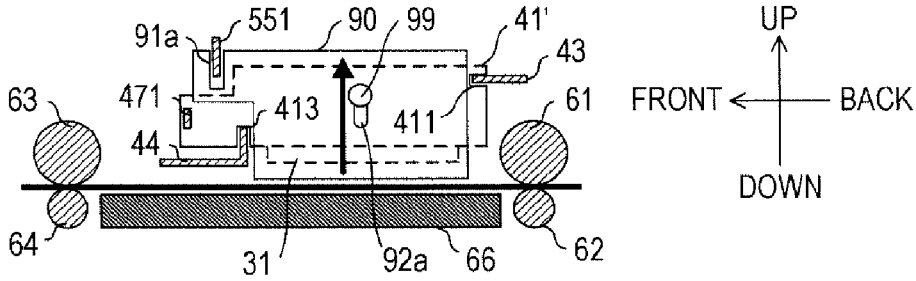
FIG. 10A is a side view showing a peripheral configuration of a carriage in an image forming apparatus according to a second embodiment.
Figure 10B:
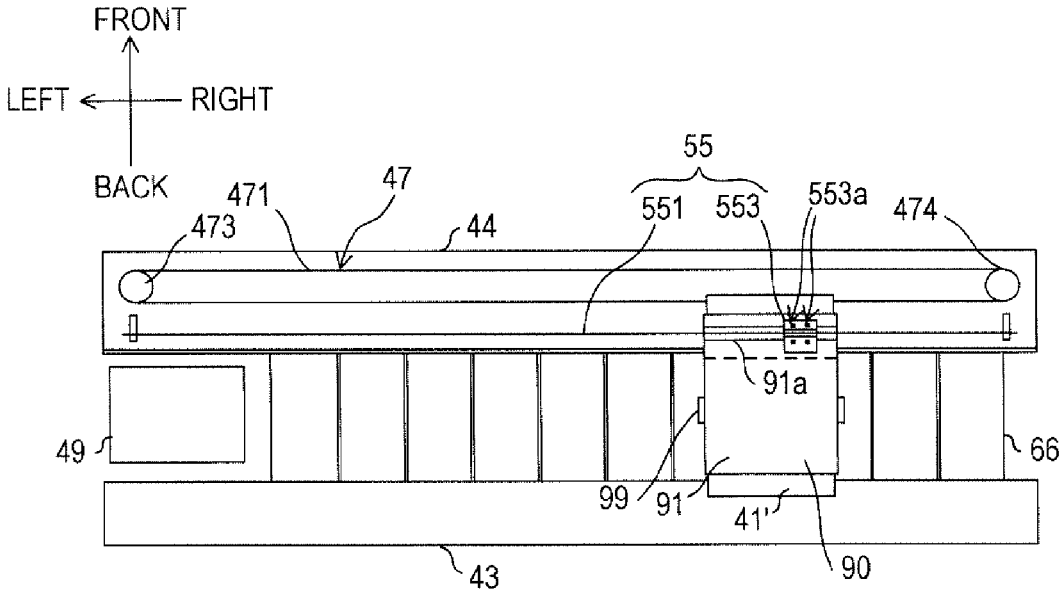
FIG. 10B is a top view showing a carriage conveyance mechanism according to the second embodiment.

As shown in FIG. 10A, in the image forming apparatus 2, the frame member 90 is attached to the carriage 41' in such a manner as to be hooked on a screw 99 fixed on the carriage 41'.

Figure 11:
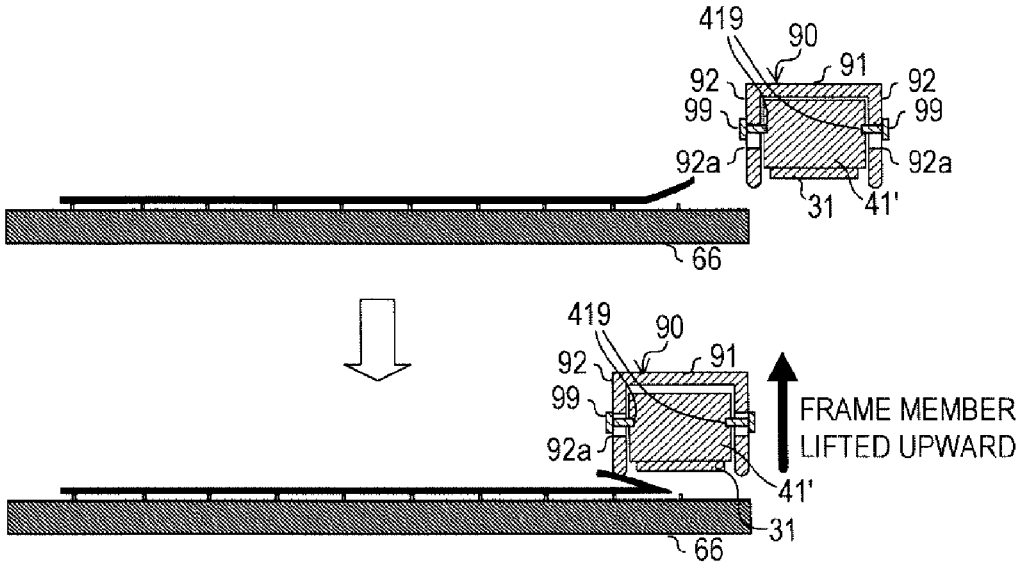
FIG. 11 is an explanatory drawing showing displacement of a frame member of the carriage, resulting from interference with a sheet.

Specifically, the carriage 41' has a screw hole 419, which is screwed together with the screw 99, provided on each of left and right sides of the carriage 41' (see FIG. 11). On the other hand, the frame member 90 is configured by coupling an upper part constituting body 91 and a side part constituting body 92 downwardly extending from each of left and right edges of the upper part constituting body 91. On the side part constituting body 92, a vertically elongated through-hole 92*a* is provided on a position corresponding to the screw hole 419 provided on the carriage 41'.

As shown in FIGS. 10A and 11, a breadth (horizontal width) of the through-hole 92*a* is set to a length corresponding to a diameter of the screw 99, and a length (vertical width) of the through-hole 92*a* is set to a length greater than the diameter of the screw 99.

The upper part constituting body 91 of the frame member 90 has a groove portion 91*a* provided parallel to the main scanning direction. In the second embodiment, the encoder fence 551 is inserted into the groove portion 91*a*. Specifically, the encoder fence 551 is positioned in the groove portion 91*a* with a predetermined space therebetween so as not to contact with a bottom of the groove portion 91*a*.

At a position corresponding to the groove portion 91*a* of the upper part constituting body 91, the encoder sensor 553 is embedded in such a manner as to sandwich the encoder fence 551 inserted into the groove portion 91*a*.

On the other hand, the carriage 41' is shaped such that an upper front portion thereof corresponding to a vicinity of the groove portion 415 of the carriage 41 of the first embodiment is concaved. The frame member 90 is attached to the thus shaped carriage 41' from above in such a manner as to surround an upper surface and the left and right sides of the carriage 41'. Hereat, the encoder sensor 553 mounted on the frame member 90 is positioned in the concavely shaped area of the carriage 41'.

The screw 99 is inserted through each of the left and right through-holes 92*a* provided on the frame member 90, and is screwed together with the screw hole 419 of the carriage 41'. With such a configuration, the frame member 90 is attached to the carriage 41' so as to be able to move upwardly by a length corresponding to the length of the through-hole 92*a*.

The side part constituting body 92 is configured such that a lower end thereof is positioned below an undersurface (nozzle surface) of the recording head 31 when the frame member 90 is attached to the carriage 41'.

According to the image forming apparatus 2 configured as such, the side part constituting body 92 is moved ahead of the recording head 31 when the carriage 41' is moved in the main scanning direction. Therefore, when a curled or bent sheet is fed, which may cause paper jam, the sheet is brought into contact with the side part constituting body 92 before the nozzle part of the recording head 31 comes into contact with the sheet. As a result, the frame member 90 is lifted upward, and the encoder sensor 553 is displaced upward in synchronization with the frame member 90. Consequently, the light emitting/receiving position of the encoder sensor 553 is changed with respect to the encoder fence 551.

In the image forming apparatus 2, the carriage conveyance error determination processing is executed in a same manner as in the image forming apparatus 1 of the first embodiment. The upward lift of the frame member 90 due to the contact between the side part constituting body 92 provided in the traveling direction of the carriage 41' and the sheet is detected. The conveyance of the carriage 41' can be thereby stopped promptly before the nozzle part of the recording head 31 comes into contact with the sheet.

Accordingly, according to the image forming apparatus 2, the recording head 31 can be inhibited more effectively from being damaged due to the contact of the nozzle part of the recording head 31 with the sheet. Further, according to the present embodiment, even in a case where the carriage 41' is not readily lifted upward upon contact with the sheet because the carriage 41' and the recording head 31 are heavy in weight, the contact with the sheet can be detected at an early stage by configuring the frame member 90 to be light in weight. The conveyance of the carriage 41' can be thereby promptly stopped at an early stage of the paper jam occurrence process.

Therefore, according to the present embodiment, even in a case where the recording head 31 is heavy in weight as in the image forming apparatus in which the recording head 31 includes an ink cartridge therein, the conveyance of the carriage 41' can be promptly stopped at an early stage of the paper jam occurrence process. Specifically, in the present embodiment, it is preferable that the frame member 90 is configured lighter than a total weight of the carriage 41' and the recording head 31.

The embodiments of the present invention have been described above. Each configuration described in the embodiments corresponds to a configuration which may be described in the claims as follows: The carriage 41 having the recording head 31 mounted thereon in the first embodiment corresponds to an example of a conveyed object which may be described in the claims. The carriage 41' having the recording head 31 mounted thereon and the frame member 90 attached thereto as an example of an additional element in the second embodiment corresponds to another example of a conveyed object which may be described in the claims. The plane orthogonal to the vertical direction in which the conveyed object is supported by the frames 43 and 44 as examples of a guide element corresponds to an example of a reference plane which may be described in the claims. The linear encoder 55 including the encoder fence 551 provided along a plane which perpendicularly intersects a sheet conveyance surface along the platen 66 which is parallel to the plane orthogonal to the vertical direction, i.e., the example of the reference plane, corresponds to an example of a linear encoder which may be described in the claims.

The slits 551*a*, 551*b*, 551*c*, and 551*d* on the encoder fence 551 correspond to examples of light-transmitting portions which may be described in the claims. The portions where no slits are formed on the encoder fence 551 correspond to examples of light-shielding portions which may be described in the claims.

A combination of the carriage conveyance mechanism 40, the CR motor 51, the driving circuit 53, and the CR conveyance control unit 102 corresponds to an example of a conveyance unit which may be described in the claims. The encoder signal processing unit 103 corresponds to an example of a measurement unit which may be described in the claims. A hardware configuration that performs the processings in S110-S175 corresponds to an example of a determination unit which may be described in the claims. A hardware configuration that performs the processings in S180 and S190 corresponds to an example of a conveyance stop unit which may be described in the claims. A hardware configuration that performs the processings in S185 and S197 corresponds to an example of an abnormality annunciation unit which may be described in the claims. A combination of the sheet conveyance mechanism 60, the LF motor 71, the driving circuit 73, the sheet conveyance control unit 104 and the like corresponds to an example of a sheet conveyance unit which may be described in the claims. A hardware configuration that performs the processing in S193 corresponds to an example of a sheet discharge unit in an abnormal state which may be described in the claims.

The present invention should not be limited by the above-described embodiments, and can be practiced in various manners. For example, in the above-described embodiments, the present invention is applied to the image forming apparatuses 1 and 2, but the present invention may be applied to various conveyance devices using a linear encoder other than the image forming apparatuses 1 and 2. For example, the present invention may be applied to an image reading apparatus and the like, in which a conveyed object is a reading unit (line sensor and the like), and displacement of the reading unit in a direction orthogonal to a reference plane during conveyance may be detected.

In the above-described embodiments, the configurations of the image forming apparatuses 1 and 2, in which the carriage 41, 41' is supported by the frames 43 and 44, are explained, but the carriage 41, 41' may be configured to be supported by one guide shaft 417 (see FIG. 2) which penetrates through the carriage 41, 41'. In this case, when the carriage 41, 41' comes into contact with the sheet, the carriage 41, 41' is rotated around the guide shaft and inclines. The encoder sensor 553 is displaced upward or downward perpendicularly to the sheet conveyance surface in synchronization with the displacement (rotation) of the carriage 41, 41'.

Accordingly, the technique of the present invention may be utilized in such an image forming apparatus, and it is possible to detect contact of the carriage 41, 41' with the sheet by determining whether or not the encoder sensor 553 is displaced upward or downward.

Alternatively, in the above-described embodiments, the encoder fence 551 is provided along the plane perpendicular to the reference plane, but it is sufficient if the encoder fence 551 is provided on a plane which intersects the reference plane. It is true that the displacement of the carriage 41, 41' can be detected more certainly by providing the encoder fence 551 along the plane perpendicular to the reference plane, but it is sufficient if the encoder fence 551 intersects the reference plane at an angle which enables the displacement of the carriage 41, 41' in a direction orthogonal to the reference plane to be detected. Additionally, it is not necessary for the sheet conveyance surface to conform to the reference plane.

Moreover, it is not always necessary to display the error message or bring the carriage to an emergency stop. Abnormality annunciation may be performed by emitting sound or light from the image forming apparatus 1, 2.

What is claimed is:

1. A conveyance device comprising:

a conveyed object;

a guide element that guides the conveyed object in a predetermined conveying direction while supporting the conveyed object;

a conveyance unit that conveys the conveyed object in the conveying direction along the guide element;

a linear encoder that outputs an encoder signal corresponding to displacement of the conveyed object;

wherein the linear encoder comprises:

an encoder fence, which is elongated in the conveying direction, provided on an intersecting plane that intersects a reference plane orthogonal to a direction in which the guide element supports the conveyed object, and having a plurality of light-transmitting portions that transmit light and a plurality of light-shielding portions that shield light arranged alternately in the conveying direction on a side along the intersecting plane;

an encoder sensor fixed on the conveyed object, which includes a light-emitting element and a light-receiving element provided in such a manner as to sandwich therebetween a portion of the encoder fence having the light-transmitting portions and the light-shielding portions formed thereon, and outputs the encoder signal in accordance with a light-receiving state of the light-receiving element that receives light outputted from the light-emitting element;

wherein the encoder fence is configured to have the light-transmitting portions and the light-shielding portions formed thereon so that a first point on each boundary between each of the light-transmitting portions and each of the light-shielding portions adjacent to each other and a second point on the each boundary, which is positioned separately from the first point with respect to a direction along the side of the encoder fence and perpendicular to the conveying direction, are separately positioned with respect to the conveying direction, and a controller configured to:

measure a time interval between edges of the encoder signal of rectangle-like shape outputted from the linear encoder; and determine whether or not the encoder sensor moving in synchronization with the conveyed object is displaced in a direction perpendicular to the reference plane based on a change in a measured value.

2. The conveyance device as set forth in claim 1, wherein the controller is configured to determine that the encoder sensor is displaced in the direction perpendicular to the reference plane when a latest measured value changes by a predetermined amount or more with respect to a second latest measured value; and to determine that the encoder sensor is not displaced in the direction perpendicular to the reference plane when the latest measured value does not change by the predetermined amount or more.

3. The conveyance device as set forth in claim 1, wherein the encoder fence is configured to have the light-transmitting portions and the light-shielding portions arranged on the side of the encoder fence in the conveying direction so that the each boundary is linearly shaped, extending inclined at a predetermined angle with respect to the direction perpendicular to the conveying direction.

4. The conveyance device as set forth in claim 1, wherein the encoder fence is configured to have the light-transmitting portions and the light-shielding portions arranged on the side of the encoder fence in the conveying direction so that the each boundary is composed of a linearly-shaped first area extending along the direction perpendicular to the conveying direction and a linearly-shaped second area extending inclined at a predetermined angle with respect to the direction perpendicular to the conveying direction.

5. The conveyance device as set forth in claim 1, wherein the encoder fence is configured to have the light-transmitting portions and the light-shielding portions arranged on the side of the encoder fence in the conveying direction so that the each boundary is curvedly shaped and has a point where a tangential line to the each boundary extends in the direction perpendicular to the conveying direction.

6. The conveyance device as set forth in claim 1, wherein the controller is further configured to:

stop conveyance operation of the conveyed object performed by the conveyance unit when determining that the encoder sensor is displaced in the direction perpendicular to the reference plane.

7. The conveyance device as set forth in claim 1, wherein the controller is further configured to:

annunciate abnormality to a user when the determining that the encoder sensor is displaced in the direction perpendicular to the reference plane.

8. The conveyance device as set forth in claim 1, wherein the controller is further configured to:

stop conveyance operation of the conveyed object performed by the conveyance unit when determining that the encoder sensor is displaced in the direction perpendicular to the reference plane; and annunciate abnormality to a user when determining that the encoder sensor is displaced in the direction perpendicular to the reference plane.

9. The conveyance device as set forth in claim 1, wherein the conveyed object comprises:

a main body supported by the guide element; and an additional body that is lighter than the main body and provided on the main body displaceably in the direction perpendicular to the reference plane, wherein the encoder sensor is provided on the additional body.

10. The conveyance device as set forth in claim 1, wherein the conveyed object comprises:

a main body supported by the guide element; and an additional body provided on the main body displaceably in the direction perpendicular to the reference plane;

wherein the additional body is attached such that at least a part of an area thereof is moved ahead of the main body when the conveyed object is conveyed, and wherein the encoder sensor is provided on the additional body.

11. The conveyance device as set forth in claim 1, wherein the conveyed object includes a recording head that forms an image onto a sheet.

12. The conveyance device as set forth in claim 11, wherein the conveyed object comprises:

the recording head;

a carriage that includes the recording head thereon and is supported by the guide element; and an additional body provided on the carriage displaceably in the direction perpendicular to the reference plane;

wherein the additional body is configured to be lighter than a total weight of the recording head and the carriage, and wherein the encoder sensor is provided on the additional body.

13. The conveyance device as set forth in claim 11, wherein the conveyed object comprises:

the recording head;

a carriage that includes the recording head thereon and is supported by the guide element; and an additional body provided on the carriage displaceably in the direction perpendicular to the reference plane;

wherein the additional body is attached such that at least a part of an area thereof is moved ahead of the recording head when the conveyed object is conveyed, and wherein the encoder sensor is provided on the additional body.

14. The conveyance device according to claim 1, wherein the controller includes a processor; and a memory having computer-executable instructions stored thereon that, when executed by the processor, perform the measuring and determining.

15. An image forming apparatus, comprising:

a conveyed object that includes a recording head that forms an image onto a sheet;

a guide element that guides the conveyed object in a predetermined conveying direction while supporting the conveyed object;

a conveyance unit that conveys the conveyed object in the conveying direction along the guide element;

a linear encoder that outputs an encoder signal corresponding to displacement of the conveyed object;

the image forming apparatus being configured to form a sequence of line images along the conveying direction onto the sheet placed opposite the recording head by causing the recording head to perform an image forming operation onto the sheet while moving the conveyed object in the conveying direction through the conveyance unit, wherein the linear encoder comprises:

an encoder fence, which is elongated in the conveying direction, provided on an intersecting plane that intersects a reference plane orthogonal to a direction in which the guide element supports the conveyed object, and having a plurality of light-transmitting portions that transmit light and a plurality of light-shielding portions that shield light arranged alternately in the conveying direction on a side along the intersecting plane; and an encoder sensor fixed on the conveyed object, that includes a light-emitting element and a light-receiving element provided in such a manner as to sandwich therebetween a portion of the encoder fence having the light-transmitting portions and the light-shielding portions formed thereon, and outputs the encoder signal in accordance with a light-receiving state of the light-receiving element that receives light outputted from the light-emitting element;

wherein the encoder fence is configured to have the light-transmitting portions and the light-shielding portions formed thereon so that a first point on each boundary between each of the light-transmitting portions and each of the light-shielding portions adjacent to each other and a second point on the each boundary, which is positioned separately from the first point with respect to a direction along the side of the encoder fence and perpendicular to the conveying direction, are separately positioned with respect to the conveying direction;

a controller configured to:

measure a time interval between edges of the encoder signal of rectangle-like shape outputted from the linear encoder; and determine whether or not the encoder sensor moving in synchronization with the conveyed object is displaced in a direction perpendicular to the reference plane based on a change in a measured value.

16. The image forming apparatus as set forth in claim 15, comprising:

a sheet conveyance unit that feeds the sheet to an image forming position where the image is formed by the recording head, and discharges the sheet, onto which the image is formed at the image forming position, from the image forming position, wherein the controller is further configured to cause the sheet conveyance unit to discharge the sheet fed at the image forming position when determining that the encoder sensor is displaced in the direction perpendicular to the reference plane in an abnormal state.

17. The image forming apparatus according to claim 15, wherein the controller includes a processor; and a memory having computer-executable instructions stored thereon that, when executed by the processor, perform the measuring and determining.

* * * * *